United States Patent [19]

Yamada

[11] 4,062,751

[45] Dec. 13, 1977

[54] ELECTROPLATING DRUM FOR RELATIVELY LARGE FASTENERS AND THE LIKE

[75] Inventor: Arthur S. Yamada, Los Angeles, Calif.

[73] Assignee: TRW Inc., Redondo Beach, Calif.

[21] Appl. No.: 700,699

[22] Filed: June 28, 1976

[51] Int. Cl.[2] ..... C25D 17/06; C25D 17/16

[52] U.S. Cl. ..... 204/212; 204/213; 204/297 W

[58] Field of Search ..... 204/297 W, 212, 231, 204/213, 287, 201, 285

[56] References Cited

U.S. PATENT DOCUMENTS

| | | | |
|---|---|---|---|
| 2,249,609 | 7/1941 | Jackson | 204/213 |
| 2,766,201 | 10/1956 | Luther | 204/213 |
| 3,039,950 | 6/1962 | Oelgoet | 204/297 W X |
| 3,117,071 | 1/1964 | Creese | 204/297 W X |
| 3,340,174 | 9/1967 | Buynak | 204/213 |
| 3,785,952 | 1/1974 | Ritzenhoff | 204/297 W |
| 3,804,732 | 4/1974 | Goodkin | 204/287 X |

*Primary Examiner*—Arthur C. Prescott

*Attorney, Agent, or Firm*—John J. Connors; Donald R. Nyhagen; Edwin A. Oser

[57] ABSTRACT

Relatively large parts, such as large fasteners and the like, are mass electroplated in a plating drum rotatable in a plating solution, without damaging contact of the parts with one another, by confining the parts in separate plating cells of the drum containing openings for circulation of plating solution through the cells and electrodes between which the parts move back and forth during drum rotation to effect exposure of the entire surface area of each part to the electroplating action.

19 Claims, 8 Drawing Figures

ELECTROPLATING DRUM FOR RELATIVELY LARGE FASTENERS AND THE LIKE

BACKGROUND OF THE INVENTION

1. Field of the Invention

This invention relates generally to electroplating apparatus and more particularly to a novel drum-type electroplating apparatus for relatively large parts, such as large fasteners and the like.

2. Prior Art

Heretofore, it has been common practice to batch electroplate relatively small parts, such as small fasteners and the like, using rotary drum-type electroplating apparatus. A typical electroplating apparatus of this kind has a plating drum which rotates in an electroplating solution and contains one or more plating chambers for receiving a batch of parts to be plated. The walls of each plating chamber contain openings through which plating solution enters the chamber. Each plating chamber contains at least one of the plating electrodes for contact with the parts in the chamber. The other plating electrode is located either within the chamber or within the plating solution tank, whereby during operation of the plating apparatus, the parts in each drum chamber are electroplated. Examples of such electroplating drums are found in U.S. Pat. Nos. 639,766; 2,865,831; 3,582,526; 3,650,937; 3,850,727; and Great Britain Patent No. 1,204,902.

While a drum type electroplating apparatus of the kind discussed above is suitable for relatively small parts, such as small fasteners and the like, it is not suitable for relatively large parts, such as large bolts and other fasteners, for the reason that during rotation of the plating drum, the loose parts in the drum roll about in the drum chambers and thus constantly impact one another. This impact of the parts presents no problems when the parts are relatively small. On the other hand, when the parts are relatively large, such as large fasteners and the like, such impact of the parts with one another tends to damage the parts, such as the threads of bolts, and mars the electroplated surfaces of the parts. Accordingly, a need exists for a drum type electroplating apparatus for relatively large fasteners and other parts which is not subject to this type of part damage. A search of the prior art in this regard developed the following U.S. Pat. Nos.: 560,931, 1,367,567, 3,491,013 745,378, 2,071,261, 3,607,703, 923,319, 2,079,037, 1,353,194, 3,058,902.

SUMMARY OF THE INVENTION

This invention provides an improved drum-type electroplating apparatus wherein the large parts to be plated are contained in separate plating cells on the plating drum, with each cell containing a single part only. These plating cells have openings through which plating solution circulates through the cells. Each cell is sized to be slightly larger than the part to be plated, such that during rotation of the plating drum, each part undergoes limited back and forth movement within its plating cell. Contained within each plating cell are a pair of cathodic electrodes between which the part in the cell undergoes back and forth motion during rotation of the plating drum, in such a way that the part is virtually always in contact with one electrode or the other and yet, over a period of time, the entire surface area of the part is exposed to the plating action in the cell.

In one described embodiment of the invention, the remaining anodic electrodes are located between adjacent plating cells. In a second described embodiment, the anodic electrodes surround the plating cells. In both described embodiments, the plating cells are contained in removable modules of the plating drum.

During operation of the present improved electroplating apparatus, the electroplating drum is driven in rotation in an appropriate electroplating solution which enters the plating cells through the openings in the cells. During this drum rotation, the parts to be plated, which are individually confined within the plating cells of the drum, undergo limited back and forth motion within their respective cells between the cathodic electrodes in the cells. Accordingly, the parts are electroplated over their entire surface area, and being individually confined within their plating cells, are prevented from damaging contact with one another.

DESCRIPTION OF THE PREFERRED EMBODIMENTS

Figure 1:
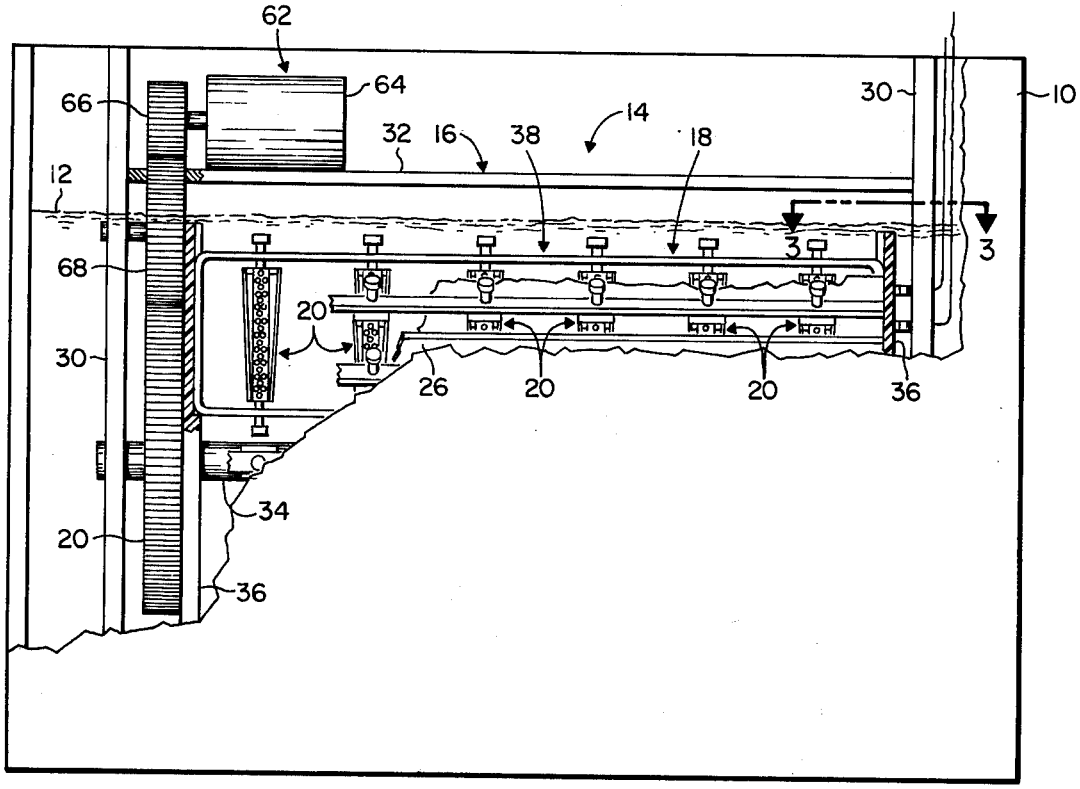
FIG. 1 is a side elevation, partly broken away, of an improved drum-type electroplating apparatus according to the invention.
Figure 2:
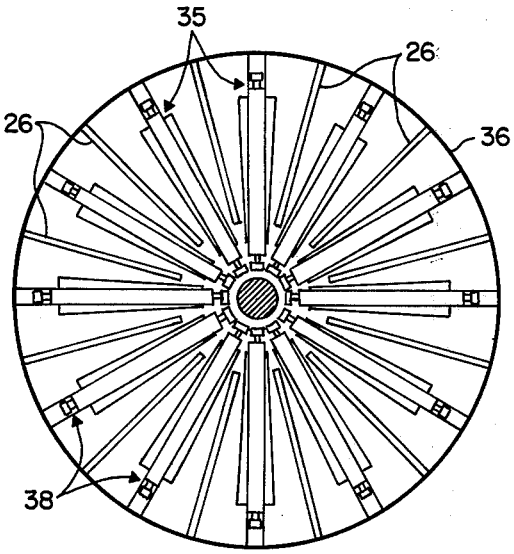
FIG. 2 is an end view of the electroplating drum of the apparatus with one end plate of the drum omitted for the sake of clarity.
Figure 3:
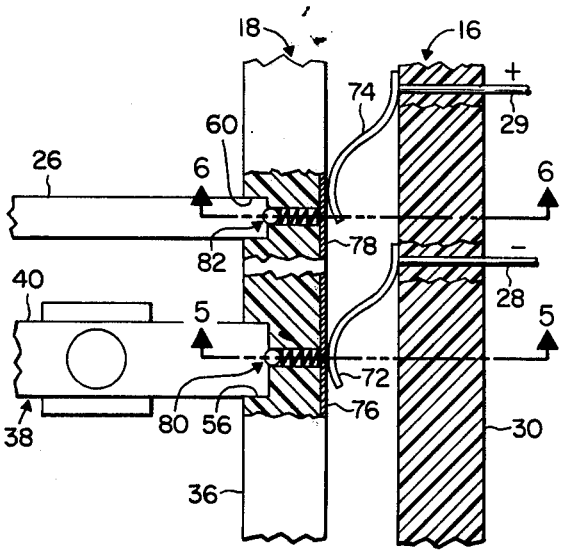
FIG. 3 is an enlarged fragmentary view of the drum looking in the direction of the arrows in line 3—3 in FIG. 1.

Turning first to FIGS. 1 through 6, there is illustrated a tank 10 for containing an electroplating solution 12 and an electroplating apparatus 14 according to the invention. This electroplating apparatus is removable from the tank to permit placement in and removal from the apparatus of the parts to be electroplated.

Electroplating apparatus 14 comprises a frame 16 rotatably supporting an electroplating drum 18. This electroplating drum includes a plurality of plating cells 20 for receiving the parts 22, in this instance large bolts, to be electroplated. Each plating cell 20 is sized to contain a single part or bolt 22, only, in such a way that the part is free to undergo limited movement in the cell. As shown in the drawings, each cell has openings through which the plating solution 12 may enter the cell.

Contained within each plating cell 20 are two cathodic electrodes 24. These electrodes are so spaced and arranged within each plating cell 20 that during rotation of the electroplating drum 18 in the plating solution 12, the part 22 in the cell undergoes back and forth motion between the electrodes. Accordingly, the part is virtually always in contact with one or the other of the electrodes and yet, over a period of time, the entire surface area of the part is exposed to the plating solution. Also carried by the plating drum 18, adjacent the plating cells 20, are anodic electrodes 26. As will be seen presently, the cathodic electrodes 24 and the anodic electrodes are electrically connected to a d.c. source through negative and positive leads 28 and 29, whereby during rotation of the plating drum 18 in the plating solution 12, in the course of operation of the electroplating apparatus 14, the entire surface area of each part 22 is electroplated. Moreover, owing to the fact that they are individually confied within the plating cells 20, the parts 22 are restrained against damaging contact with one another during rotation of the electroplating drum.

Referring now in more detail to the illustrated electroplating apparatus 14, the frame 16 comprises a pair of normally upright parallel end-plates 30 rigidly joined to one another by a horizontal frame plate 32 located above the electroplating drum 18. This frame plate 32 is located on the frame 16 in such a way as to be situated above the surface of the electro-plating solution 12 in the plating tank 10 when the electro-plating apparatus 14 is positioned in the tank for electroplating operation.

The electroplating drum 18 has a central shaft 34 below the frame plate 32 extending between and rotatably supported at its ends in the frame plates 30. Rigidly fixed to this shaft between the frame plates 30 are a pair of circular end-plates 36. Uniformly spaced about the drum shaft 34 between the drum end-plates 36 are a plurality of plating cell assemblies or modules 38. As explained below, each cell module 38 includes a plurality of the plating cells 20 and extends between and is removably supported at its ends by the drum end-plates 36, whereby the cell modules are removable from the plating drum 18. The anodic electrodes 26 are located betweem the adjacent cell modules 38 and, like the modules, extend between and are removably supported at their ends by the drum end-plates 36 in such a way as to permit periodic replacement of the electrodes.

Figure 4:
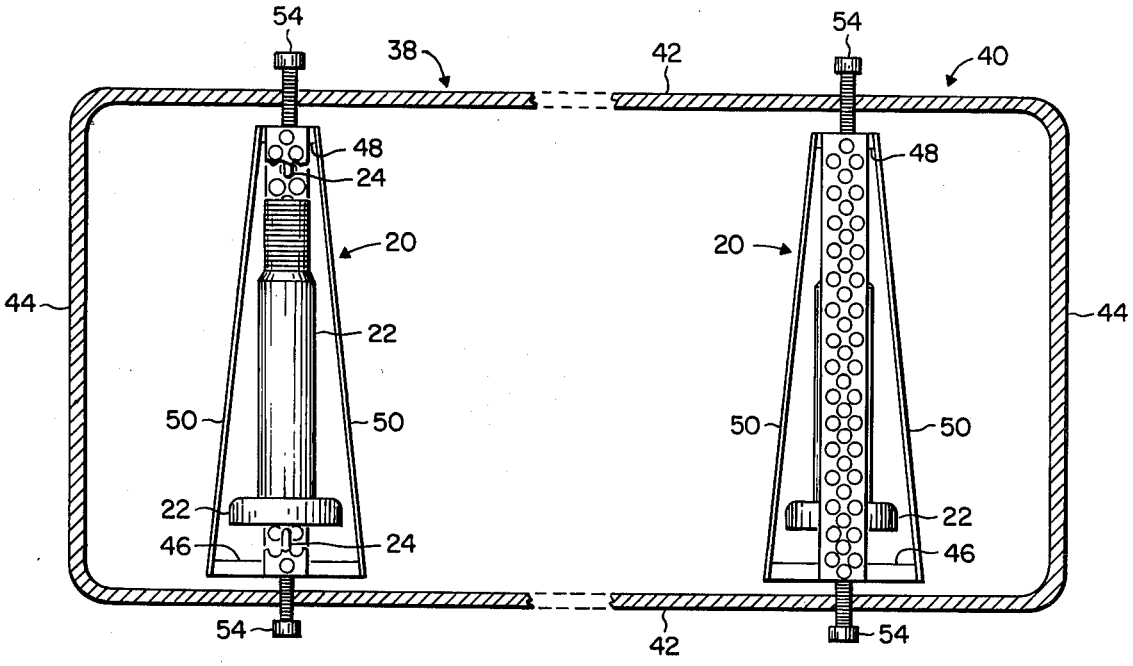
FIG. 4 is an enlarged side elevation of a removable plating cell module of the plating drum, the cell module being broken for the sake of clarity.

The several plating cell modules 38 are essentially identical and will now be described in detail by reference to FIG. 4. As shown in this latter figure, each module has an open rectangular frame 40 such as a metal bar which is bent into the illustrated open rectangular configuration. This frame has longitudinal sides 42 and ends 44. The plating cells 20 of the module 38 are arranged side by side along the module frame 40 and extend between and are secured to the longitudinal frame sides 42 in the manner described below. In the particular electroplating apparatus illustrated, each plating cell module 38 comprises six plating cells 20. It will be readily evident to those versed in the art, however, that each cell module may have any desired number of plating cells.

As noted earlier, and shown in FIG. 4 of the drawings, the parts 22 which are adapted to be electroplated in the illustrated electroplating apparatus 14 are large bolts. Each of the plating cells 20 of each plating cell module 38 is adapted to receive one bolt 22 and, to this end, has the elongate, generally tapered configuration illustrated in FIG. 4. Each plating cell 20 has relatively large and relatively small rectangular plastic end-plates 46 and 48, respectively, joined along their four sides by perforated plastic connecting strips 50 to form an open tapered cage-like structure for receiving the bolt 22 in the position shown in FIG. 4. In this position, the bolt extends lengthwise of the cell between the cell end-plates 46, 48 with the head of the bolt positioned in the large end of the cell, adjacent the end-plate 46. The plastic strips 50 are sufficiently stiff to normally preserve the tapered cage-like configuration of the plating cell 20 and to confine the part or bolt 22 in the cell and yet are sufficiently resilient, or flexible, to permit insertion of the bolt into and removal of the bolt from the cell through any one of the gaps between the adjacent strips.

The several plating cells 20 of each cell module 38 are arranged with their longitudinal axis parallel to one another and transverse to the longitudinal sides 42 of the module frame 40. Each plating cell 20 is secured to the frame 40 by cell mounting bolts 54 which are threaded in the longitudinal frame sides 42 and the cell end-plates 46, 48. The inner ends of the mounting bolts 54 for each plating cell 20 project into the interior of the cell and provide the cathodic electrodes 24 of the cell for contacting the bolt 22 in the cell. Referring to FIG. 4, it will be observed that the mounting bolts 54 of each plating cell 20 are adjusted so that the axial spacing between their inner electrode ends 24 is somewhat greater than the length of the bolt 22 to be plated, whereby the bolt is capable of limited axial movement in the cell, from one electrode to the other. When either end of the bolt contacts the adjacent electrode 24, the opposite end of the bolt is spaced from the other electrode, as shown in FIG. 4.

Figure 5:
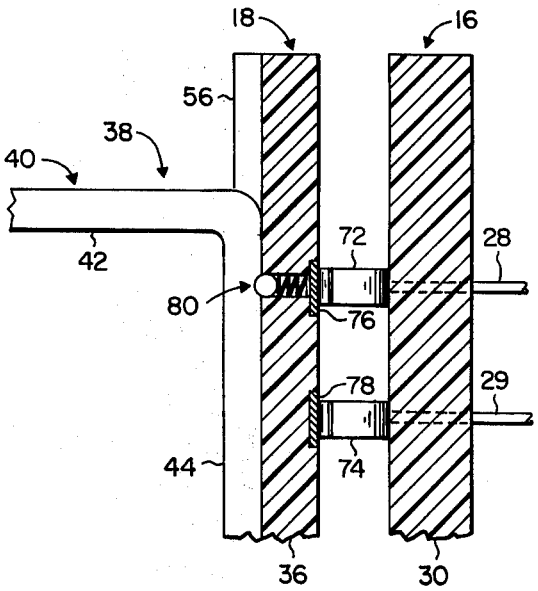
FIG. 5 is a section taken on line 5—5 in FIG. 3.

As noted earlier, the plating cell modules 38 of the electroplating drum 18 are removably mounted between the plating drum end-plates 36. To this end, the ends 44 of each module frame 40 fit slidably within radial grooves 56 entering the inner confronting sides of the end-plates. These grooves open endwise through the outer edges of the plates and terminate at their radially inner ends a distance from the drum shaft 34 for radially positioning the cell modules 38 in the plating drum 18 in their normal electroplating positions shown in FIG. 1. The modules may be retained in position in the plating drum 18 in any convenient way. In the particular electroplating apparatus illustrated, for example, the modules are retained in the drum by spring detents, as shown in FIG. 5 and explained later.

Figure 6:
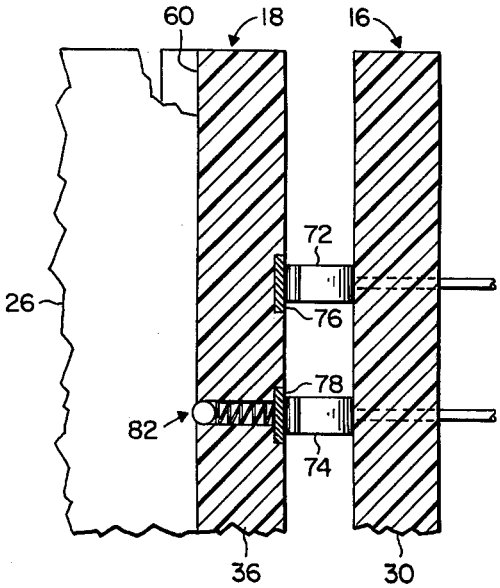
FIG. 6 is a section taken on line 6—6 in FIG. 3.

It will be recalled from the earlier description that the anodic electrodes 26 are also removable mounted between the drum end-plates 36 in the regions between the adjacent plating cell modules 38. The particular anodic electrodes illustrated are generally flat rectangular plates of the metal to be plated. The ends of these electrode plates fit within radial grooves 60 entering the inner confronting sides and opening through the outer edges of the drum end-plates. The electrode plates 26 are retained in position within their drum grooves 60 by spring detents, as shown in FIG. 6 and explained below.

Referring to FIG. 1, it will be observed that the electroplating drum 18 is mounted on the frame 16 in a position such that when the electroplating apparatus 12 is positioned in the plating tank 10, the drum is submerged in the electroplating solution 12. Driving means 62 are provided for driving the drum in rotation in the solution. The particular driving means illustrated comprises a motor 64 mounted on the upper frame plate 32. Mounted on the shaft of this motor is a pinion 66 which drives the plating drum 18 through an idler gear 68 rotatably mounted on one of the frame plates 30 and a large pinion gear 70 fixed to the drum shaft 34.

As noted earlier, the electrical potentional necessary for plating operation of the electroplating apparatus 14 is furnished by a d.c. voltage source through negative and positive electrical leads 28, 29. These leads connect to spring contacts or contact brushes 72, 74 which are mounted on the right-hand frame plate 30 in FIG. 1 and press against concentric conductor rings 76, 78 on the outer side of the adjacent plating drum end-plate 36. Caged in the end-plate 36, behind the negative conductor ring 76, are ball detents 80. The detent springs seat against the conductor ring and the detent balls project into the end-plate grooves 56 for electrical contact with the plating cell module frames 40, as shown best in FIG. 5. Similar spring detents 82 are caged in the drum end-plate 36 behind the conductor ring 78. The detent springs seat against the ring 78 and the detent balls project into the end-plates grooves 60 for electrical contact with the anodic electrodes 26, as shown in FIG. 6.

Thus, the negative and positive leads 28, 29 of the plating voltage source are electrically connected to frames 40 of the plating cell modules 38 and the anodic electrodes 26 through the contacts 72, 74, conductor rings 76, 78, and detents 80 82, respectively. An electrical plating potential is thereby applied between the cathodic electrodes 24 of the plating cells 20 and the anodic electrodes 26. It will be understood, of course, that the contact brushes 72, 74 are electrically insulated from one another. The drum end-plates 36 are preferably constructed of a suitable plastic or other electrical insulating material for electrically isolating from one another the conductor rings 76, 78, detents 80, 82, and electrodes 24, 26.

The plating cell module frames 40 and the anodic electrodes 26 are recessed, as shown in FIGS. 5 and 6, to receive the detents 80, 82. These detents thus serve the dual function of electrical contacts for establishing an electrical plating potential between the electrodes 24, 26 and as mechanical detents for yieldably securing the cell moduels 38 and anodic electrodes 26 in the plating drum 18.

In use of the electroplating apparatus 14, the plating cell modules 38 are removed from the plating drum 18 and the bolts 22 or other parts to be electroplated are inserted into the plating cells 20 through the spaces between the cell strips 50. The cathodic electrodes 24 of the plating cells 20 are adjusted so that the spacing between these electrodes is slightly greater than the length of the parts. The modules 38 are then replaced in the plating drum 18, and the electroplating apparatus 14 is placed in the electroplating tank 10 within the electroplating solution 12, as shown in FIG. 1.

The electroplating drum 18 is now driven in rotation by its motor 64, while a plating potential is applied between the electrodes 24, 26 through the leads 28, 29. As the drum turns in the electroplating solution 12, the bolts 22 move endwise back and forth by gravity in the plating cells 20, between the cell electrodes 24, in such a way that each bolt is virtually always in contact with a cathodic electrode 24 and yet during the plating operation, the entire surface area of the bolt is exposed to the plating action. The bolts are thereby electro-plated over their entire surface area. Moreover, being caged within their separate plating cells 20, the bolts are prevented from damaging contact with one another during the plating operation.

Figure 7:
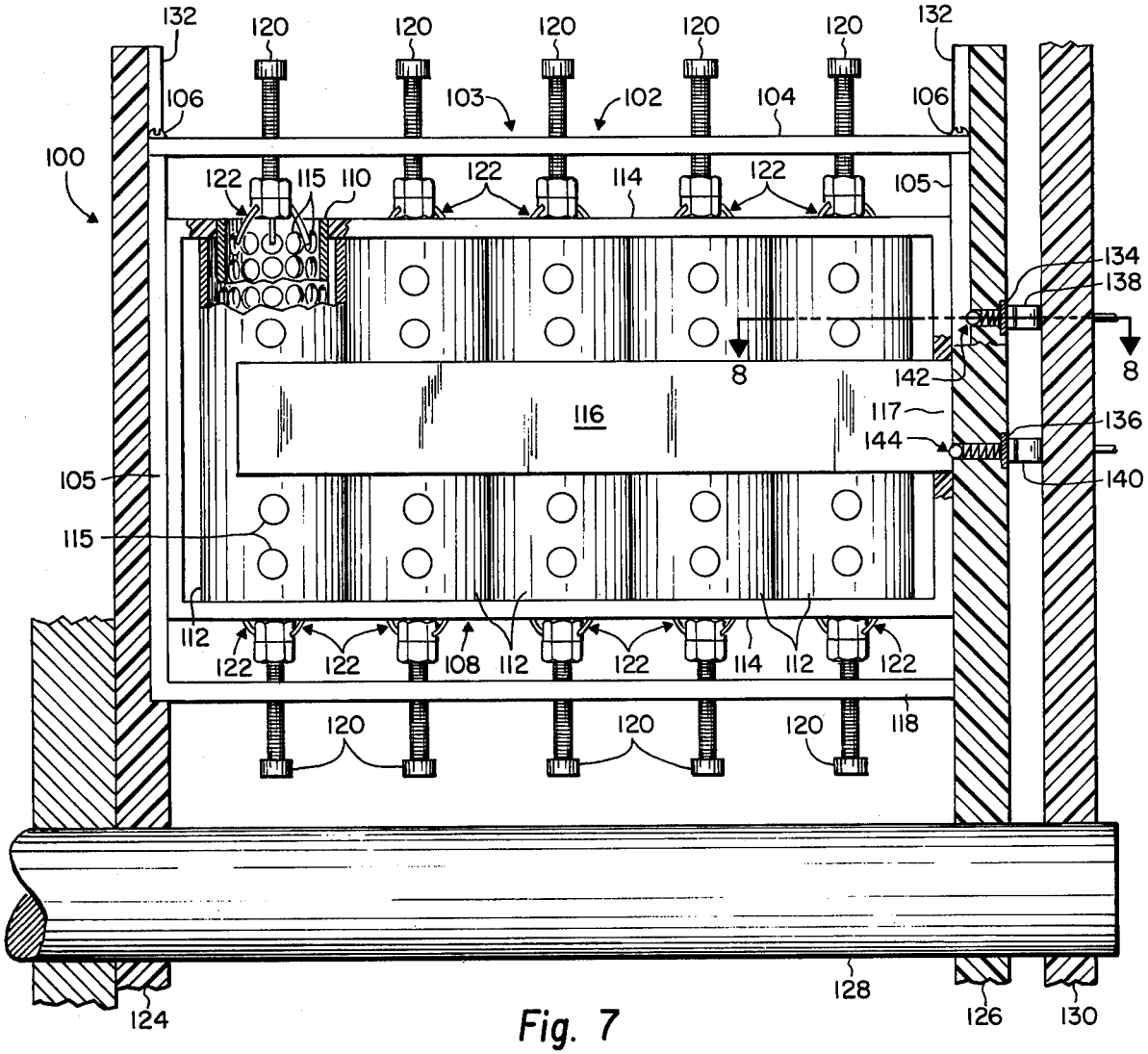
FIG. 7 is a fragmentary section through a modified plating drum for the electroplating apparatus.
Figure 8:
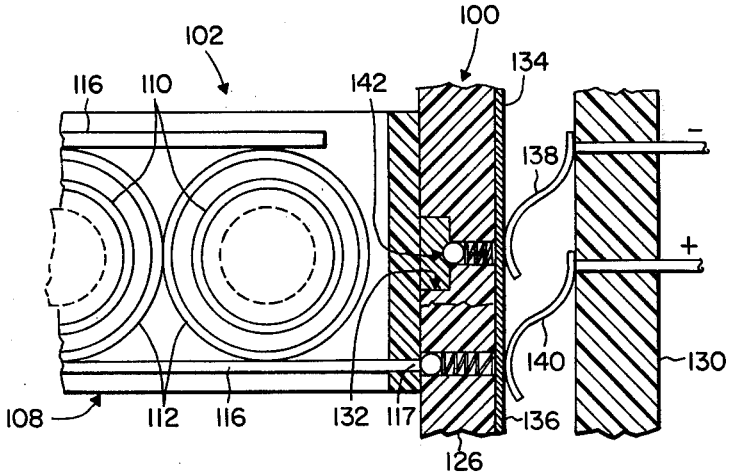
FIG. 8 is a section taken on line 8—8 in FIG. 7.

Turning now to FIGS. 7 and 8, the modified electroplating drum 100 includes a plurality of removable plating cell assemblies or modules 102 (only one shown). Each plating cell module 102 has a metal frame 103 similar to that of plating cell module 38, except that on longitudinal side 104 of frame 100 is releasibly secured to the frame ends 105, in this instance by screws 106. The frame side 104 is thus removable from the frame proper. Fixed within the frame 103 is a second dielectric frame 108 of plastic, or the like. Frame 108 carries a plurality of dielectric tubular plating cells 110 for receiving individual bolts or other objects to be plated, and anodic electrode sleeves 112 concentrically surround the cells. The plating cells 110 open endwise through the longitudinal sides 114 of the frame 108. In the particular embodiment shown, the ends of the plating cells 110 extend through and are fixed within openings in the frame sides 114. The ends of electrode sleeves 112 are secured to the inner sides of the frame sides 114.

Both the plating cells 110 and anodic electrode sleeves 112 have openings 115 through which plating solution may enter the cells during operation of the plating apparatus. The electrode sleeves 112 are electrically joined to one another by conductor plates 116. One end 117 of one conductor plate projects through an opening in and terminates flush with the outer surface of the adjacent end of the plastic cell frame 108, as shown in FIG. 8.

Threaded in the removable longitudinal side 104 and the opposite longitudinal side 118 of the metal frame 103 of each plating cell module 102, on the axis of its plating cells 110, are screws 120 forming cathodic electrodes. On the inner ends of these electrodes are spaced prongs 122 for engaging the bolts or other work parts in the plating cells.

The modified plating drum 100 is similar to the plating drum 18 of FIGS. 1 through 6 and, like the latter drum, has dielectric end-plates 124, 126 mounted on a shaft 128. The plating drum is rotatably supported between a pair of frame plates 130 (only one shown) and driven in rotation by drive means (not shown) in the same manner as drum 18. Entering the inner confronting sides of the drum end-plates 124, 126 are pairs of radial grooves 132 (only one pair shown) for slidably receiving the ends of the plating module frames 103 in the same manner as in the plating apparatus of FIGS. 1 through 6.

The right hand plating drum end-plate 126 in FIGS. 7 and 8 has a pair of concentric conductor rings 134, 136 at its outer side. Bearing against these conductor rings are flexible contacts or contact brushes 138, 410 mounted on the adjacent frame plate 130. These contacts are connected to negative and positive plating voltage leads. Behind and seating against the negative conductor ring 134 are ball detents 142 (only one shown) which project into the end-plate grooves 132 for electrical contact with the ends 105 of the plating cell module frames 103. Behind and seating against the positive conductor ring 134 are ball detents 144 (only one shown) for engaging the ends 117 of the anodic electrode plates 116 of the plating cell modulus 102.

From this description, it will be understood that the anodic sleeve electrodes 112 and the cathodic electrodes 120 of each plating cell module 102 are electrically connected to the positive and negative plating voltage leads, respectively, when the cell module is positioned in the plating drum 100. The bolts or other parts to be plated are placed in the plating cells 110 by removing the module frame sides 104. The cathodic electrodes in each plating cell are adjusted to a spacing slightly greater than the length of the part to be plated, such that during rotation of the plating drum in an electrode plating solution, the entire surface area of each part is electroplated, as in the electroplating apparatus of FIGS. 1 through 6.

I claim:

1. Electroplating apparatus for electroplating relatively large parts, such as large fasteners and the like, comprising:

an electroplating drum to be rotated in an electroplating solution and including a plurality of plating cells having openings for entrance of said plating solution into the cells;

each plating cell containing a pair of spaced first electrodes of the same polarity and adapted to receive between said electrodes a single part to be plated for limited back and forth movement of the part between the electrodes during rotation of said drum in said solution to expose the entire surface area of the part to the solution;

a second electrode of the opposite polarity adjacent each plating cell; and means for connecting said electrodes to a plating voltage source.

2. Electroplating apparatus according to claim 1 wherein:

each plating cell is elongated radially of said drum; and said first electrodes are located within the ends, respectively, of said cells.

3. Electroplating apparatus according to claim 2 including:

means for adjusting the spacing between the electrodes in each plating cell.

4. Electroplating apparatus according to claim 3 wherein:

said plating cells are removable from said drum for insertion of parts into and removal of parts from the cells.

5. Electroplating apparatus according to claim 4 wherein:

said plating drum includes a plurality of removable plating cell modules each comprising a multiplicity of said plating cells and the respective first cell electrodes; and said cell modules are removable from said drum for insertion of parts into and removal of parts from the cells.

6. Electroplating apparatus according to claim 5 wherein:

each plating cell module comprises a frame mounting the respective plating cells and movable into and from supporting engagement with said drum.

7. Electroplating apparatus according to claim 6 wherein:

said plating cell modules are spaced circumferentially about said plating drum; and said second electrodes are located between the circumferentially adjacent cell assemblies.

8. Electroplating apparatus according to claim 6 wherein:

said plating cell modules are spaced circumferentially about said drum; and said second electrodes comprise sleeves about said plating cells.

9. Electroplating apparatus according to claim 1 wherein:

said plating cells are spaced circumferentially about said drum; and said second electrodes are located between the circumferentially adjacent cells.

10. Electroplating apparatus according to claim 1 wherein:

said plating cells comprise elongate cells having flexible sidewalls which are separable to insert and remove parts into and from the cells.

11. Electroplating apparatus according to claim 1 wherein:

said second electrodes comprise sleeves about said plating cells.

12. Work holding means for electroplating apparatus of the character described comprising:

an elongate plating cell to be rotated in an electroplating solution and having openings for entrance of the solution into the cell;

a pair of electrodes of the same polarity at the ends, respectively, and along the longitudinal axis of said cell;

means for adjusting at least one of said electrodes along said axis to adjust the spacing between said electrodes, and said cell having a length greater than its major transverse dimension and being adapted to receive between said electrodes a single part to be plated for limited back and forth movement of the part between the electrodes during rotation of the cell in said solution to expose the entire surface area of the part to the solution.

13. Work holding means for electroplating apparatus of the character described comprising:

a plating cell to be rotated in an electroplating solution and having openings for entrance of the solution into the cell;

said cell containing a pair of electrodes of the same polarity and being adapted to receive between said electrodes a single part to be plated for limited back and forth movement of the part between the electrodes during rotation of the cell in said solution to expose the entire surface area of the parts to the solution; and said plating cell having flexible sidewalls which are separable to insert and remove a part into and from the cell.

14. Work holding means according to claim 12 including:

a second tubular electrode of opposite polarity about said plating cell.

15. Work holding means according to claim 12 wherein:

said plating cell comprises a perforate sleeve; and a second tubular electrode of opposite polarity surrounding said sleeve.

16. An electroplating cell module for electroplating apparatus of the character described comprising:

a frame;

a plurality of elongate plating cells mounted side by side on said frame; and said cell module being adapted to be rotated in an electroplating solution and each plating cell containing a pair of spaced electrodes of the same polarity and being adapted to receive between said electrodes a single part to be plated for limited back and forth movement of the part between the electrodes during rotation of said module in said solution to expose the entire surface area of the part to the plating solution.

17. A plating cell module according to claim 16 including:

means for adjusting the spacing between said electrodes of each plating cell.

18. A plating cell module according to claim 16 wherein:

each plating cell has flexible sidewalls which are separable to insert and remove parts into and from the cell.

19. A plating cell module according to claim 16 wherein:

each plating cell comprises a sleeve containing said electrodes in the ends of said sleeve; and a second tubular electrode of opposite polarity about each plating cell sleeve.

* * * * *